US009035983B2

(12) United States Patent
Onodera

(10) Patent No.: US 9,035,983 B2
(45) Date of Patent: May 19, 2015

(54) THERMAL PRINTER

(71) Applicant: SATO HOLDINGS KABUSHIKI KAISHA, Tokyo (JP)

(72) Inventor: Hitoshi Onodera, Tokyo (JP)

(73) Assignee: SATO HOLDINGS KABUSHIKI KAISHA (JP)

( * ) Notice: Subject to any disclaimer, the term of this patent is extended or adjusted under 35 U.S.C. 154(b) by 0 days.

(21) Appl. No.: 14/381,898

(22) PCT Filed: Feb. 25, 2013

(86) PCT No.: PCT/JP2013/054764
§ 371 (c)(1),
(2) Date: Aug. 28, 2014

(87) PCT Pub. No.: WO2013/129314
PCT Pub. Date: Sep. 6, 2013

(65) Prior Publication Data

US 2015/0054906 A1 Feb. 26, 2015

(30) Foreign Application Priority Data

Feb. 29, 2012 (JP) ..... 2012-043619

(51) Int. Cl.
*B41J 2/335* (2006.01)

(52) U.S. Cl.
CPC ..... *B41J 2/335* (2013.01)

(58) Field of Classification Search
USPC ..... 347/197, 198, 171
See application file for complete search history.

(56) References Cited

U.S. PATENT DOCUMENTS

| | | | | |
|---|---|---|---|---|
| 5,366,302 | A * | 11/1994 | Masumura et al. | 347/197 |
| 7,145,583 | B2 * | 12/2006 | Ito | 347/197 |
| 8,436,880 | B2 * | 5/2013 | Matsushima et al. | 347/197 |
| 8,449,207 | B2 * | 5/2013 | Takabatake et al. | 347/197 |
| 8,553,058 | B2 * | 10/2013 | Huang | 347/198 |
| 2002/0080223 | A1 * | 6/2002 | Connor | 347/198 |

FOREIGN PATENT DOCUMENTS

| | | |
|---|---|---|
| JP | 62-121943 | 8/1987 |
| JP | 6-143736 | 5/1994 |
| JP | 2004-299279 | 10/2004 |

OTHER PUBLICATIONS

International Search Report dated Apr. 16, 2013 issued in corresponding International patent application No. PCT/JP2013/054764.

* cited by examiner

*Primary Examiner* — Kristal Feggins
(74) *Attorney, Agent, or Firm* — Ostrolenk Faber LLP

(57) ABSTRACT

A thermal printer capable of easily attaching and detaching a thermal head frame having a thermal head mounted thereon. A thermal printer (10) in which a thermal head frame (34) having a thermal head (26) mounted thereon is attachable to and detachable from a printer body (16), includes: the thermal head frame has a protrusion (34*a*) at one end and a claw portion (36*b*) at the other end; a pair of thermal head frame mounting portions (40*a*) and (40*b*) in the printer body (16) oppose each other at a distance that is smaller than a width of the thermal head frame (34); a hole (42*a*) in portion (40*a*) receives the protrusion and a hole (42*b*) in portion (40*b*) receives the claw portion; and spring members (44*a*) and (44*b*) between the pair of thermal head frame mounting portions (40*a*) and (40*b*) urge the thermal head frame to a position setting the holes (42*a*, 42*b*).

4 Claims, 4 Drawing Sheets

THERMAL PRINTER

CROSS-REFERENCE TO RELATED APPLICATIONS

The present application is a 35 U.S.C. §371 National Phase conversion of PCT/JP2013/054764, filed Feb. 25, 2013, which claims priority of Japanese Patent Application No. 2012-043619, filed Feb. 29, 2012, the contents of which are incorporated by reference herein. The PCT International Application was published in the Japanese language.

TECHNICAL FIELD

The present invention relates to a thermal printer which performs printing on a sheet using a thermal head, and more particularly to a thermal printer in which a thermal head frame having a thermal head mounted thereon can be attached to and detached from a printer body.

BACKGROUND ART

There exist thermal printers which perform printing using a thermal head. The thermal head may be a so-called line thermal head in which a number of heating elements are formed on a substrate so as to be arranged in a row, and the arrangement direction of the row of heating elements is perpendicular to a sheet transport direction.

A platen roller is disposed to oppose the thermal head, and the thermal head is biased against and comes into pressure contact with the platen roller. A sheet transport path on which sheets are transported is formed between the thermal head and the platen roller.

The sheet is printed by the thermal head while being transported as the platen roller rotates.

In Patent Literature 1, the thermal head is fixed to a head frame. The head frame is provided in a thermal printer body via a head frame shaft, a coil spring, and the like which are provided in the head frame.

CITATION LIST

Patent Literature

Patent Literature 1: JP 6-143736 A

SUMMARY OF INVENTION

Technical Problem

However, the thermal head frame having the thermal head mounted thereon, as in Citation Literature 1, has a problem in that it is difficult to attach and detach the thermal head frame to and from the thermal printer body during assembly, maintenance, or the replacement of the thermal head. Typically, the thermal head is damaged by wear, disconnection, or the like due to a long-term use, and the thermal head needs to be replaced.

The invention takes the foregoing circumstances into consideration. An object thereof is to provide a thermal printer capable of easily performing operations of attaching and detaching a thermal head frame having a thermal head mounted thereon, preferably without an increase in cost.

Solution to Problem

According to the invention, a thermal printer in which a thermal head frame having a thermal head mounted thereon is attachable to and detachable from a printer body, includes: a thermal head frame which has a flat protruding portion 34*a* provided at one end thereof and has a claw portion 36*b* provided at the other end thereof; a pair of thermal head frame mounting portions which are provided in the printer body to oppose each other at an interval or distance that is smaller than a width of the thermal head frame and in which a hole into which the protruding portion is inserted and a hole into which the claw portion is inserted are formed; and a spring member which is provided between the pair of thermal head frame mounting portions. According to the invention, a dedicated tool and the like are not necessary for attaching and detaching the thermal head frame having the thermal head mounted thereon, and in a reasonable configuration which should not result in an increase in the cost of the thermal printer, and thus an operation of attaching and detaching the thermal head frame can be easily performed. It is preferable that a protrusion be provided in a part of the thermal head frame where the spring member abuts on the thermal head frame during attachment and detachment. Furthermore, it is preferable that a vertical cross-section of the protrusion between the pair of thermal head frame mounting portions have an arc shape. According to the invention, friction between the parts of the thermal head frame where the spring members from the printer body abut on the thermal head frame and the spring members can be reduced during the attachment and detachment. Thus the thermal head frame having the thermal head mounted thereon is more easily attached to and detached from the printer body.

Advantageous Effects of Invention

According to the thermal printer according to the invention, it is possible to provide a thermal printer that is capable of easily performing the operation of attaching and detaching the thermal head frame having the thermal head mounted thereon preferably without an increase in cost.

DESCRIPTION OF EMBODIMENTS

Hereinafter, a preferred embodiment of a thermal printer according to the invention will be described in detail with reference to the accompanying drawings.

Figure 1:
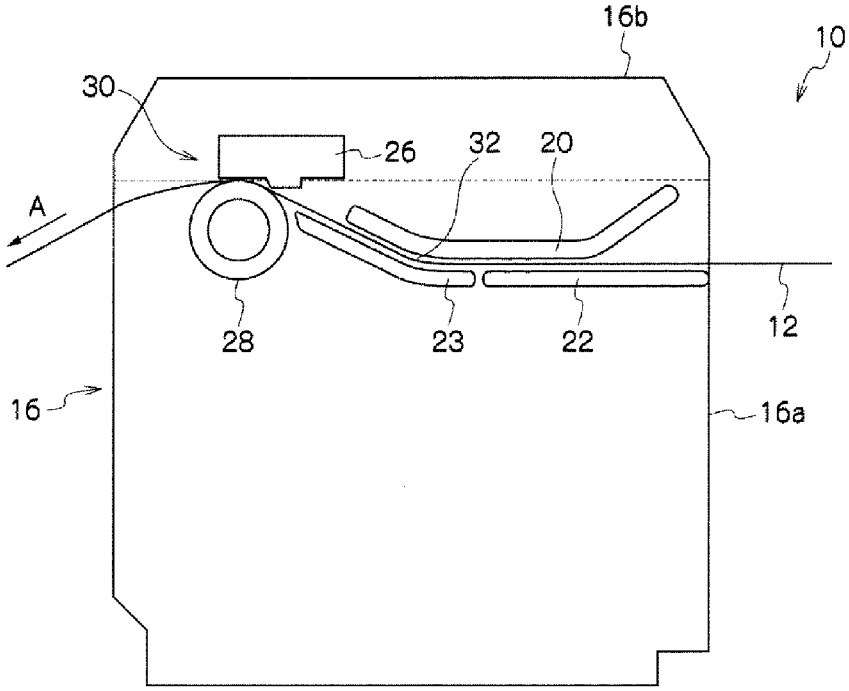
FIG. 1 is a schematic side view of the configuration of a thermal printer according to an embodiment of the invention.

FIG. 1 is a schematic side view of the configuration of a thermal printer 10 according to the invention. The thermal printer 10 is a printer which prints and issues predetermined information on an upward label surface of a label 12.

The label 12 is guided to a label guide which is comprised of an upper guide plate 20 and lower guide plates 22 and 23, and the label is fed to a printing unit 30 comprising a thermal head 26 and a platen roller 28. The rotatable shaft of the platen roller 28 is connected to the drive shaft of a motor which is rotatable normally and reversely via a timing belt or a gear (not illustrated). When the drive shaft is rotated, its rotational force is transmitted to the platen roller 28 via the timing belt or the gear, which transports the label 12 in the arrow A direction (from the upstream side to the downstream side in the transport direction) in FIG. 1.

A printer body 16 of the thermal printer 10 is generally comprised by a printer lower portion 16*a* and a printer upper portion 16*b*. The printer upper portion 16*b* can be opened and closed.

The printing unit 30 is comprised of the thermal head 26 and the platen roller 28 which are arranged to oppose each other with a label transport path 32 interposed therebetween.

The thermal head 26 is a so-called line thermal head in which a number of heating elements (not illustrated) are formed on a substrate (not illustrated) to be arranged in a row, and the thermal head is provided in such a manner that the arrangement direction of the heating elements is perpendicular to the label transport direction. At the surface of the substrate which is opposed to the surface where the heating elements are formed, a heat sink which is formed of metal to have conductivity is attached.

The thermal head 26 includes a connector (not illustrated) for a power source and a printing signal, and a wiring connector (not illustrated) from the printer body 16 is connected to the connector.

Figure 2:
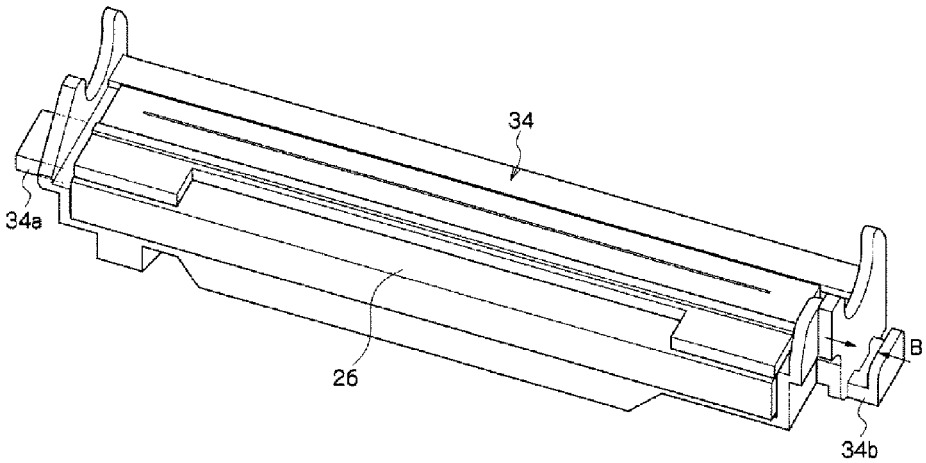
FIG. 2 is a perspective view illustrating a thermal head frame on which a thermal head of the thermal printer according to the embodiment of the invention is mounted.

As illustrated in FIG. 2, the thermal head 26 is mounted on a thermal head frame 34 to which the thermal head 26 is fixed.

The thermal head frame 34 a flat portion 34*a* is provided at one end of the thermal head frame 34, and an L-shaped claw portion 34*b* is provided at the other end thereof.

Figure 3:
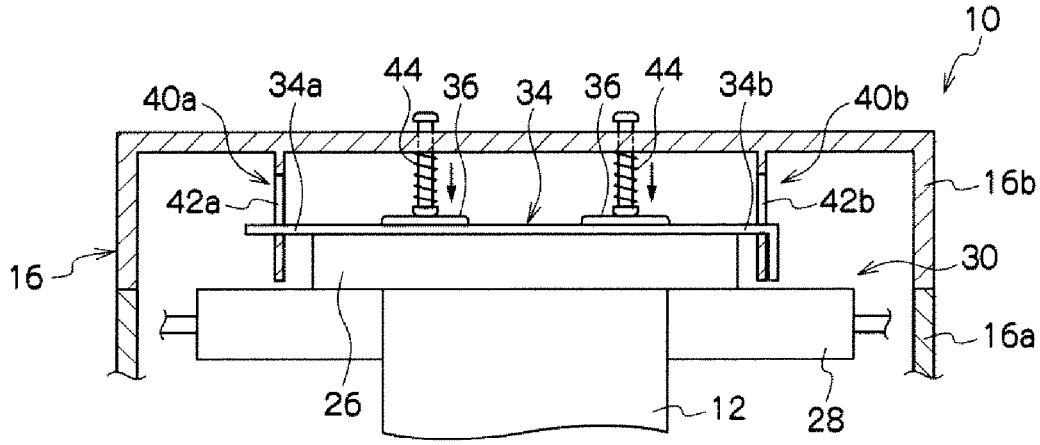
FIG. 3 is a schematic front view of the thermal printer according to the embodiment of the invention.

As illustrated in FIG. 3, a pair of thermal head frame mounting portions 40*a* and 40*b* are mounted in the printer upper portion 16*b* of the printer body 16. In the thermal head frame mounting portions 40*a*, there is a respective hole 42*a* into which the flat protruding portion 34*a* of the thermal head frame 34 is inserted. In the portion 40*b*, there is a respective hole 42*b* into which the L-shaped claw portion 34*b* is inserted.

The pair of thermal head frame mounting portions 40*a* and 40*b* oppose each other at a distance which is smaller than the width of the thermal head frame 34. Specifically, the pair of thermal head frame mounting portions 40*a* and 40*b* are separated at an interval which is equal to or greater than the width obtained by subtracting the width of the convex portion 34*a* from the width of the thermal head frame 34.

Spring members 44 and 44 are provided between the pair of thermal head frame mounting portions 40*a* and 40*b*.

The action of the thermal printer of this embodiment configured as described above is described.

First, the thermal head 26 is mounted by mounting the thermal head frame 34 having the thermal head 26 mounted thereon (see FIGS. 4(A) to 4(C)). The thermal head frame 34 having the thermal head 26 mounted thereon is mounted in a state where the printer upper portion 16*b* is opened and the thermal head 26 is separated from the platen roller 28.

First, the flat protruding portion 34*a* of the thermal head frame 34 is inserted into the hole 42*a* of the thermal head frame mounting portion 40 provided in the printer upper portion 16*b* (FIG. 4(A)). Subsequently, while the spring members 44 and 44 are pressed upward by protrusions 36 and 36, which will be described later, formed on a rear surface 35 of the thermal head frame 34 against the biasing forces of the spring members 44 and 44, the thermal head frame 34 is shifted toward the hole 42*b* of the thermal head frame mounting portion 40*b*, and the L-shaped claw portion 34*b* of the thermal head frame 34 is inserted into the hole 42*b* of the thermal head frame mounting portion 40*b* (FIG. 4(B)). Accordingly, the thermal head frame 34 having the thermal head 26 mounted thereon can be mounted in the printer body 16 (FIG. 4(C)). By engaging the L-shaped claw portion 34*b* with the hole 42*b*, movement of the heating elements of the thermal head frame 34 in the arrangement direction with respect to the thermal head frame mounting portions 40*a* and 40*b* is restricted. In addition, since the biasing forces of the spring members 44 and 44 are applied to the rear surface 35 of the thermal head frame 34, the claw portion 34*b* is fixed by being engaged with the hole 42*b* while abutting on the inner wall of the hole 42*b*.

Figure 4:
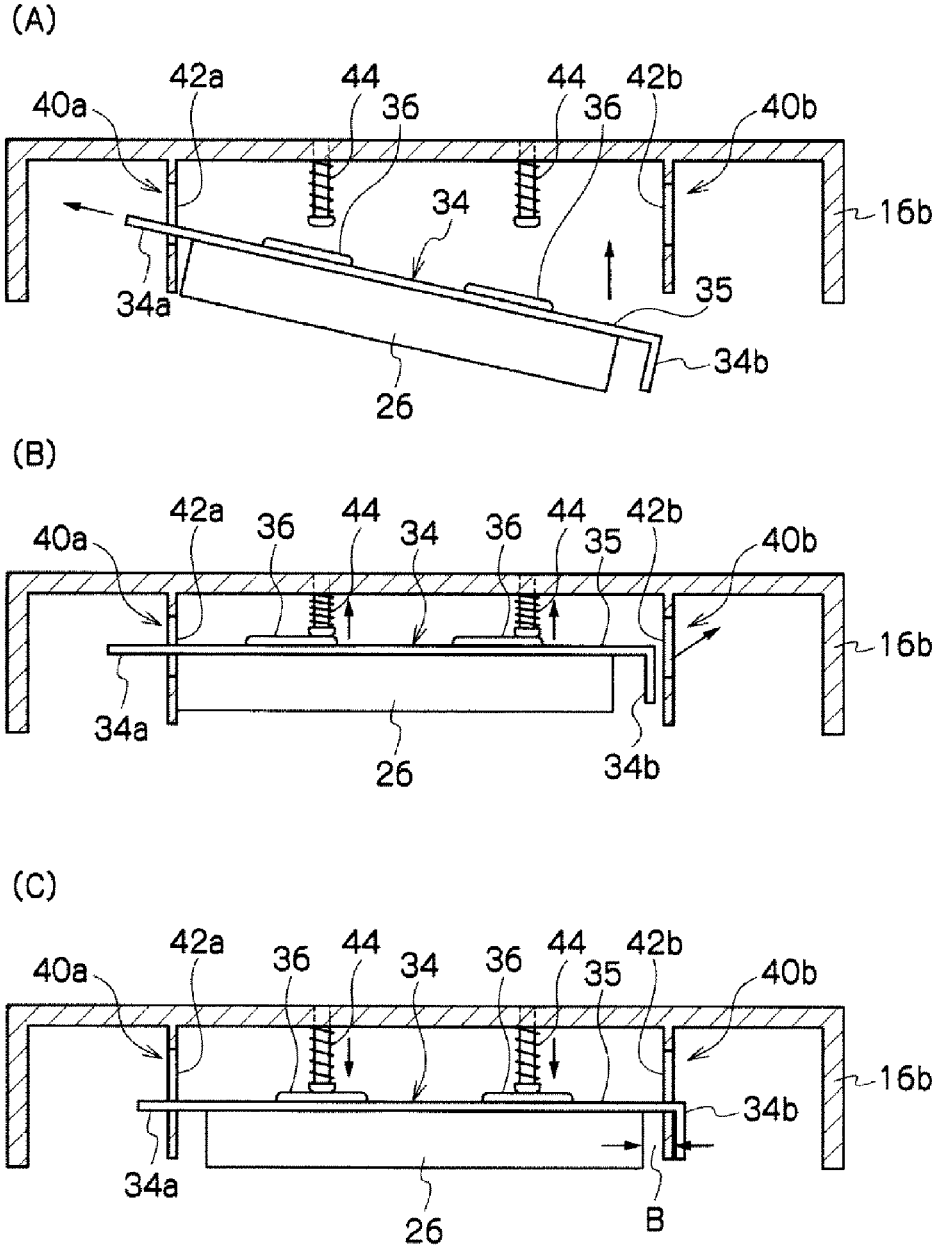
FIGS. 4(A) to 4(C) are schematic front views illustrating a process of attaching and detaching the thermal printer according to the embodiment of the invention.

In FIGS. 3 to 4(C), a gap (see FIG. 4(C)) is provided between the thermal head frame mounting portion 40*b* and the end surface of the thermal head 26. In practice, it is preferable that a gap B between the L-shaped claw portion 34*b* and the end surface of the thermal head 26 be approximately equal to the thickness of the thermal head frame mounting portion 40 so that there is substantially no gap between the thickness of the thermal head frame mounting portion 40 and L-shaped claw portion 34*b*. In this structure, the movement of the heating elements of the thermal head frame 34 in their arrangement direction can be reliably restricted.

Since the biasing forces are always applied to the thermal head frame 34 by the biasing actions of the spring members 44 and 44, backlash of the thermal head 26 in the longitudinal direction and in the direction perpendicular to the longitudinal direction can be prevented. Thereafter, when the printer upper portion 16*b* is closed, the operation of mounting the thermal head frame 34 having the thermal head 26 mounted thereon is finished, and the biasing forces of the spring members 44 and 44 are applied to the platen roller 28 side such that an appropriate printing pressure is applied.

Next, the thermal head frame 34 having the thermal head 26 mounted thereon is also removed in the state where the printer upper portion 16*b* is opened and the thermal head 26 is separated from the platen roller 28. In this state, the thermal head frame mounting portion 40*b* is slid toward the thermal head frame mounting portion 40*a* side in the state where the L-shaped claw portion 34*b* is pushed into the hole 42*b* as in FIG. 4(C) so that the claw portion 34*b* is removed from the hole 42*b*. Accordingly, the engagement between the L-shaped claw portion 34*b* and the thermal head frame mounting portion 40*b* is released, and the thermal head frame 34 having the thermal head 26 mounted thereon can be removed by performing the operations of FIGS. 4(C), 4(B), and 4(A) in this order.

As described above, according to the thermal printer of the invention, the operation of attaching and detaching the thermal head 26 to and from the printer body 16 can be very easily performed, and the positioning of the thermal head 26 can be easily performed. Particularly, a dedicated tool and the like are not necessary for attaching and detaching the thermal head frame 34 having the thermal head 26 mounted thereon. In addition, the thermal head frame 34 having the thermal head 26 mounted thereon according to the invention has a reasonable configuration which does not result in an increase in cost of the thermal printer.

Figure 5:
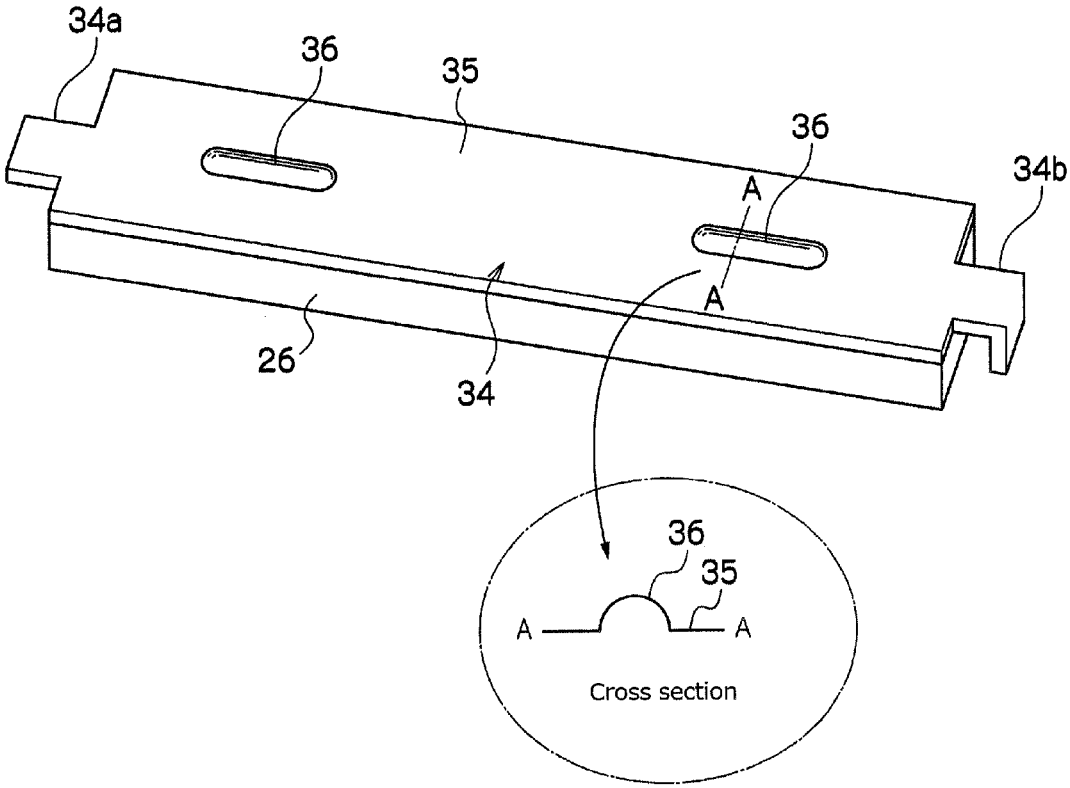
FIG. 5 is a perspective view illustrating a rear surface of the thermal head frame on which the thermal head of the thermal printer according to the embodiment of the invention is mounted.

In the invention, as illustrated in FIG. 3 or FIGS. 4(A) to 4(C), it is preferable that the protrusions 36 and 36 be provided in parts of the rear surface 35 of the thermal head frame 34 where the spring members 44 and 44 abut on the thermal head frame 34 during the attachment and detachment of the thermal head frame 34. Furthermore, as illustrated in FIG. 5, it is preferable that the protrusions 36 in vertical cross-sections A-A have an arc shape, extending along the head frame in the direction between the ends thereof. In addition, it is preferable that the protrusions 36 and 36 be formed to have lengths along the head frame over the parts on which the spring members 44 and 44 abut when the thermal head frame 34 is slid during the attachment and detachment of the thermal head frame 34.

Since the protrusions 36 and 36 are provided in the parts where the spring members 44 and 44 abut on the thermal head frame 34 during the attachment and detachment as described above, friction between the parts of the thermal head frame 34 where the spring members 44 and 44 abut on the thermal head frame 34 and the spring members can be reduced during the attachment and detachment, and thus the thermal head frame 34 having the thermal head mounted thereon is more easily attached to and detached from the printer body 16. As illustrated in FIG. 4(B), the thermal head frame 34 is shifted toward the hole 42*b* side by the protrusions 36 and 36 in a state of being pressed against the biasing forces of the spring members 44 and 44. At this time, the tip ends of the spring members 44 and 44 come into contact with the apexes of the protrusions 36 and 36 of which the vertical cross-sections have the arc shape, and thus friction generated when the thermal head frame 34 is shifted toward the hole 42*b* side is reduced. Accordingly, the thermal head frame 34 can be easily mounted. In addition, the friction can also be reduced during the removal, and thus the attachment and detachment can be easily performed.

The configuration of the thermal printer described above in the embodiment is not limited to the above-described embodiment. For example, in the figures of this embodiment, two spring members 44 are illustrated. However, one spring member or two or more spring members may be provided. In addition, in the figures of this embodiment, the spring member 44 is illustrated as a member formed by a spring. However, the spring member may be, for example, a leaf spring.

In addition, in this embodiment, the thermal printer is exemplified so that the label is fed from the outside of the thermal printer. However, the application of the invention is not limited thereto. For example, as a matter of course, a label roll may be supported by a thermal printer body.

REFERENCE SIGNS LIST

10 thermal printer
12 label
16 printer body
16*a* printer lower portion
16*b* printer upper portion
20 upper guide plate
22 lower guide plate
23 lower guide plate
26 thermal head
28 platen roller
30 printing unit
32 label transport path
34 thermal head frame
34*a* convex portion
34*b* claw portion
35 rear surface of thermal head frame
40*a*, 40*b* thermal head frame mounting portion
42*a*, 42*b* hole
44 spring member

The invention claimed is:

1. A thermal printer comprising:

a printer body;

a thermal head frame and a thermal head mounted on the frame, the frame being attachable to and detachable from the printer body;

the thermal head frame which has a protruding portion located at one end of the frame and has a claw portion located at an opposite end of the frame;

a pair of thermal head frame mounting portions mounted in the printer body oppose each other and are spaced apart at a distance that is smaller than a width of the thermal head frame;

a hole in one frame mounting portion into which the protruding portion of the head frame is inserted and a hole in the other frame mounting portion into which the claw portion is inserted; and a spring member between the pair of thermal head frame mounting portions, the spring member being configured to bias the thermal head in a direction for causing the protruding portion of the head and the claw of the head to be held in their respective holes in the opposing mounting portions.

2. The thermal printer according to claim 1, further comprising a protrusion on a part of the thermal head frame where the spring member abuts on the thermal head frame during attachment and detachment wherein the protrusion is elongate across the head frame to be between the spring and the frame as the frame is tilted during attachment and detachment from the print body.

3. The thermal printer according to claim 2, wherein a vertical cross-section of the protrusion between the pair of thermal head frame mounting portions has an arc shape extending along the frame in the direction between the ends of the frame.

4. The thermal printer according to claim 1, further comprising two of the spring members spaced apart along the thermal head.

* * * * *